US010942003B2

(12) United States Patent
DiBlasio et al.

(10) Patent No.: US 10,942,003 B2
(45) Date of Patent: Mar. 9, 2021

(54) LINEAR CHAMBER MAGAZINE

(71) Applicant: Umarex USA, Inc., Fort Smith, AR (US)

(72) Inventors: Alexander Robert DiBlasio, Jamison, PA (US); Stephen R. Lamboy, Fort Smith, AR (US)

(73) Assignee: UMAREX USA, INC., Fort Smith, AR (US)

( * ) Notice: Subject to any disclaimer, the term of this patent is extended or adjusted under 35 U.S.C. 154(b) by 0 days.

(21) Appl. No.: 16/796,720

(22) Filed: Feb. 20, 2020

(65) Prior Publication Data

US 2020/0200503 A1 Jun. 25, 2020

Related U.S. Application Data

(63) Continuation of application No. 16/141,857, filed on Sep. 25, 2018, now Pat. No. 10,605,562.

(60) Provisional application No. 62/563,031, filed on Sep. 25, 2017.

(51) Int. Cl.
*F41B 11/55* (2013.01)

(52) U.S. Cl.
CPC ..... *F41B 11/55* (2013.01)

(58) Field of Classification Search
CPC ..... F41B 11/00; F41B 11/50; F41B 11/51; F41B 11/54; F41B 11/55
USPC ..... 124/45
See application file for complete search history.

(56) References Cited

U.S. PATENT DOCUMENTS

| | | | | | |
|---|---|---|---|---|---|
| 2,790,353 | A | | 4/1957 | Bird | F41A 3/76 89/1.704 |
| 3,212,489 | A | * | 10/1965 | Merz | F41B 11/62 124/74 |
| 3,765,116 | A | | 10/1973 | Zaid | F41A 9/85 42/89 |
| 3,913,553 | A | | 10/1975 | Braughler | F41B 11/54 124/73 |
| 4,004,565 | A | * | 1/1977 | Fischer | A61M 37/0069 124/45 |
| 4,687,465 | A | | 8/1987 | Prindle | A61M 37/0069 124/45 |
| 4,760,834 | A | * | 8/1988 | Chevalier | F41A 9/25 124/51.1 |
| 4,771,757 | A | * | 9/1988 | Chevalier | F41A 9/25 124/51.1 |
| 4,986,251 | A | | 1/1991 | Lilley | F41B 11/54 124/48 |
| 5,367,810 | A | | 11/1994 | Stead | F41A 9/72 42/17 |
| 5,722,382 | A | | 3/1998 | Mendoza Orozco | F41B 11/51 124/51.1 |

(Continued)

*Primary Examiner* — Alexander R Niconovich
(74) *Attorney, Agent, or Firm* — Eric B. Fugett; Mark A. Pitchford; Pitchford Fugett, PLLC

(57) ABSTRACT

A linear magazine for an air gun advances upon actuation of a cocking mechanism. The magazine carries multiple projectiles for the air gun and translates perpendicularly to the bore (i.e., barrel) of the air gun to advance to the next projectile. The magazine places a series of projectiles in line with the bore of the gun while serving as a chamber for the projectile and gun and sealing to the air orifice and barrel bore of the air gun. In one embodiment, each hole or chamber of the linear magazine is arranged in a single row.

19 Claims, 10 Drawing Sheets

(56) References Cited

U.S. PATENT DOCUMENTS

| | | | | |
|---|---|---|---|---|
| 5,884,615 | A * | 3/1999 | Casas Salva | F41B 11/51 124/31 |
| 6,470,871 | B2 | 10/2002 | Casas-Salva | F41B 11/54 124/48 |
| 6,578,565 | B2 | 6/2003 | Casas Salva | F41B 11/54 124/40 |
| 6,698,127 | B2 | 3/2004 | Weber | F41A 9/65 42/49.01 |
| 6,877,265 | B2 | 4/2005 | Hajjar | F41A 9/68 42/19 |
| 6,915,792 | B1 | 7/2005 | Sheng | F41B 11/54 124/48 |
| 7,159,584 | B2 | 1/2007 | Maeda | F41A 9/73 124/41.1 |
| 7,694,620 | B1 * | 4/2010 | Narus | F41A 9/61 89/33.1 |
| 7,806,036 | B2 | 10/2010 | Cook | F41A 9/02 42/17 |
| 8,756,843 | B1 * | 6/2014 | Cantrell | F41A 19/12 42/6 |
| 8,783,237 | B2 * | 7/2014 | Torre | F41B 11/68 124/45 |
| 8,904,690 | B1 * | 12/2014 | Cantrell | F41A 9/64 42/6 |
| 9,103,609 | B2 * | 8/2015 | Cantrell | F41A 19/12 |
| 9,134,090 | B1 | 9/2015 | Park | F41B 11/54 |
| 9,664,475 | B1 * | 5/2017 | Maggiore | F41B 11/81 |
| 9,726,446 | B2 * | 8/2017 | Wong | F41B 11/642 |
| 9,759,503 | B2 | 9/2017 | Huang | F41A 9/27 |
| 9,803,952 | B2 | 10/2017 | Giaretta | F42B 6/10 |
| 10,066,896 | B2 | 9/2018 | Zhu | F41B 11/50 |
| 10,323,892 | B2 * | 6/2019 | Tresserras Torre | F41B 11/54 |
| 2018/0045484 | A1 | 2/2018 | Zhu | F41B 11/73 |
| 2018/0149445 | A1 | 5/2018 | Lamboy | F41B 11/54 |
| 2018/0180376 | A1 | 6/2018 | Lamboy | F41B 11/54 |
| 2019/0195594 | A1 | 6/2019 | Lamboy | F41B 11/646 |

* cited by examiner

LINEAR CHAMBER MAGAZINE

CROSS-REFERENCES TO RELATED APPLICATIONS

This application is a continuation of U.S. patent application Ser. No. 16/141,857 entitled "LINEAR CHAMBER MAGAZINE", which issued as U.S. Pat. No. 10,605,562 on Mar. 31, 2020 and which claims priority to U.S. Provisional Patent Application No. 62/563,031 entitled "LINEAR CHAMBER MAGAZINE" filed on Sep. 25, 2017 the entirety of each of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magazines for air guns. More particularly, the present invention relates to magazines for large caliber air guns.

In small caliber air guns, rotary magazines are used to provide multiple shots without reloading. Projectiles used in small caliber air guns can be driven to acceptable speeds (e.g., 500 plus feet per second) without the need to seal the projectile into the bore or chamber of the air gun. Rotary magazines are commonly used in these rifles to provide multiple shots without reloading, and they rely on metal to meatal (or plastic) contact to create the chamber and bore of the rifle.

In large caliber air guns (e.g., .30 caliber and larger) rotary magazines become impractical because they would require a diameter that would interfere with handling and operating characteristics of the rifle. Holding 5 to 8 rounds in the rotary magazine would also result in a weight increase and weight change with repeated firing that is undesirable. Additionally, providing a perfectly aligned chamber and bore together with a sufficient seal from air orifice to chamber and chamber to barrel bore for a high-power air gun (e.g., in excess of 300 foot pounds of muzzle energy) is not practical with a rotary magazine. For these reasons, large caliber high-power air guns have been single shot bolt action (or break action).

BRIEF SUMMARY OF THE INVENTION

Aspects of the present invention provide a linear magazine for an air gun that advances upon actuation of a cocking mechanism. The magazine carries multiple projectiles for the air gun and translates perpendicular to the bore of the air gun to advance to the next projectile. The magazine places a series of projectiles in line with the bore of the gun while serving as a chamber for the projectile and gun and sealing to the air orifice and barrel bore of the air gun.

In one aspect, a magazine for an air gun includes a plurality of holes, a rear rim, and a front rim. Each hole of the plurality of holes extends through the magazine. Each hole is configured to receive a projectile and thus form a chamber of the air gun when in use. The rear rim extends from a rear face of the magazine. The rear rim incircles a hole of the plurality of holes extending through the magazine. The front rim extends from a front face of the magazine. The front rim encircles the hole of the reality of holes extending through the magazine.

In another aspect, a magazine for an air gun includes a plurality of holes and a dovetail. Each hole of the plurality of holes extends through the magazine. Each hole is configured to receive a projectile and thus form a chamber of the air gun when in use. The plurality of holes extend longitudinally and are spaced laterally from one another across the magazine. The dovetail extends laterally along the magazine. The dovetail is configured to engage a track of the air gun to align the magazine within the air gun.

In another aspect, a magazine for an air gun includes a plurality of holes extending through the magazine. Each hole of said plurality of holes is configured to receive a projectile. The plurality of holes extend longitudinally interspace laterally from one another across the magazine. Each hole of the plurality of holes has a longitudinal axis that extends through a center of the hole and beyond the front face and the rear face of the magazine such that the longitudinal axes of the plurality of holes are at a common elevation when the magazine is held in an upright position.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
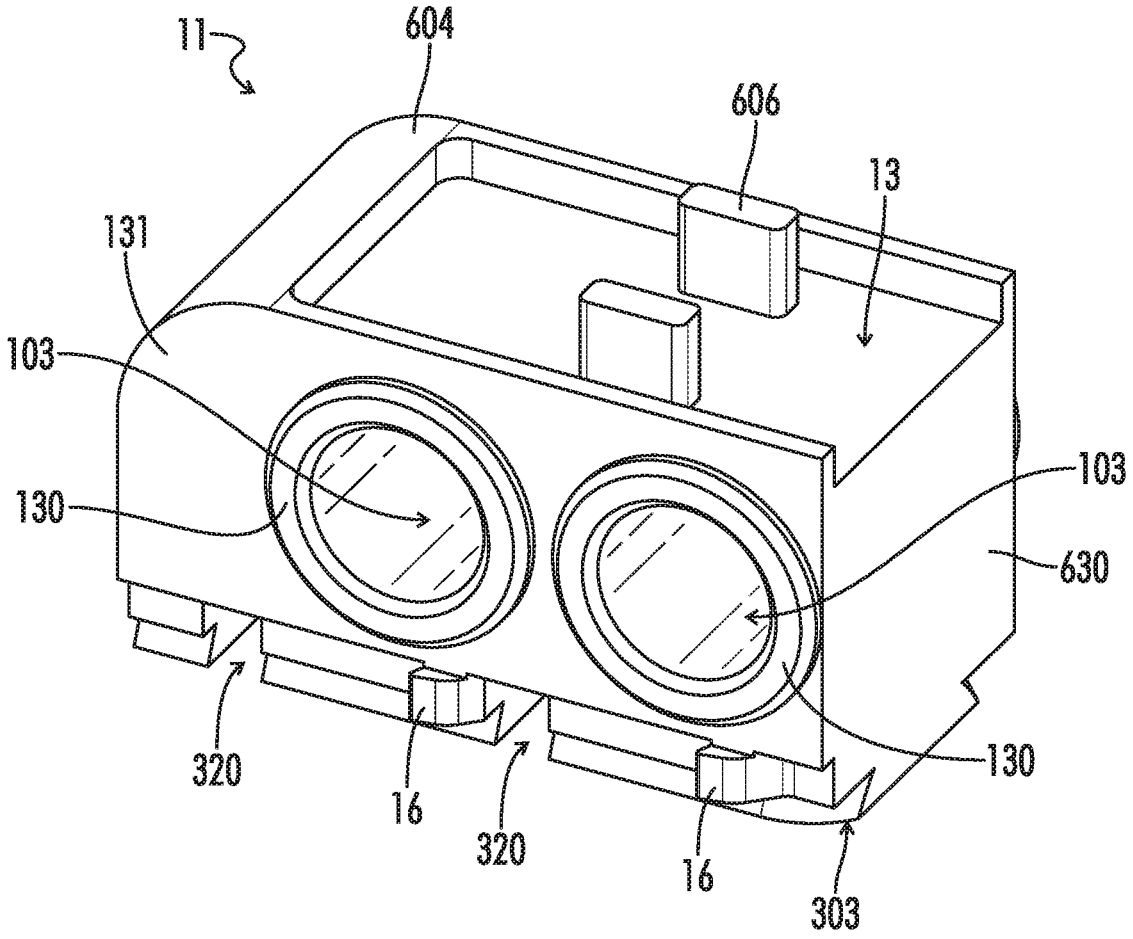
FIG. 1 is a rear isometric view of a linear magazine for an air gun.
Figure 2:
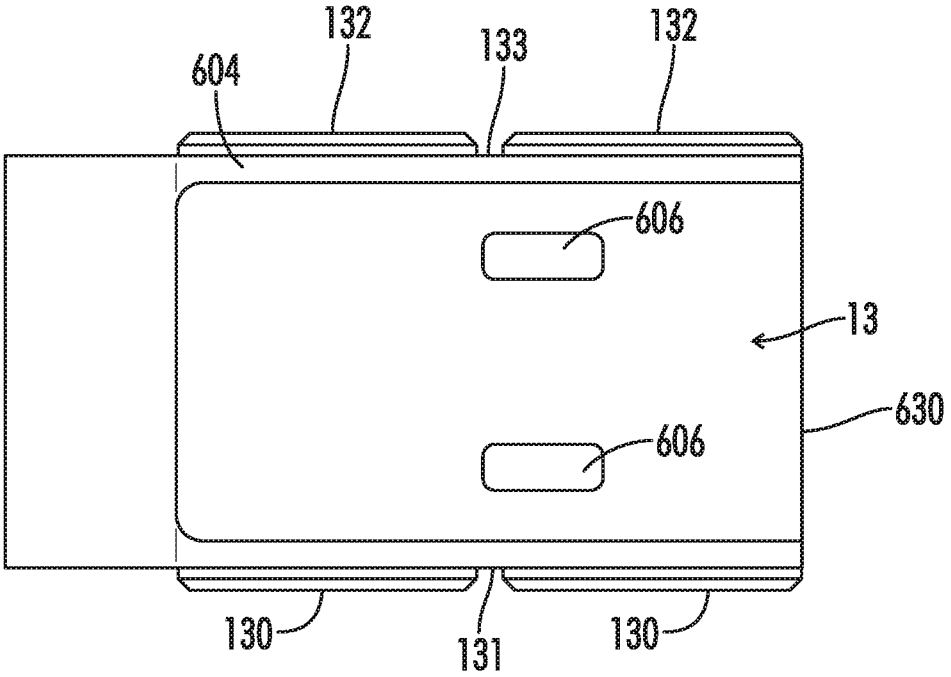
FIG. 2 is a top perspective view of the magazine of FIG. 1.
Figure 3:
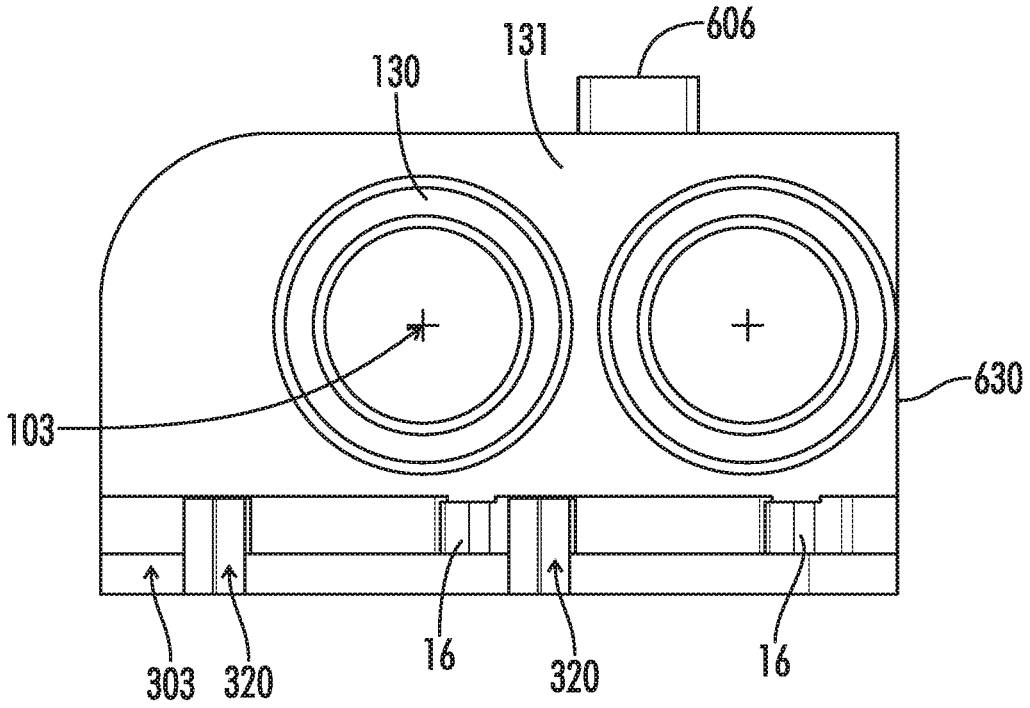
FIG. 3 is a rear perspective view of the magazine of FIG. 1.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position is determined when the magazine is properly loaded into the rifle with the rifle held in a level shooting position. As described herein, the magazine is viewed from the rear (unless described otherwise), the rear of the magazine being the side nearest the butt of the rifle when the magazine is properly loaded into the rifle. Left and right are described with respect to a right-handed rifle. One of ordinary skill in the art will appreciate that features may be reversed from left to right to adapt a rifle to a left-handed shooter. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

As used herein, air gun and air rifle are interchangeable. Although it is expected that the linear magazine described herein will typically be used with high-power large caliber air rifles suitable for large game hunting, it is contemplated that the linear magazine described herein may be used with smooth bore air guns of any caliber and capacity. Additionally, although the linear magazine described herein is expected to be typically used with pre-charged pneumatic air rifles, the linear magazine may be used with any kind of air gun including helium operated guns and manually pressurized guns.

Referring to FIGS. 1-10, in one embodiment, a magazine 11 for an air gun 105 includes a plurality of holes 103, a rear rim 130, and a front rim 132. Each hole 103 of the plurality of holes is configured to receive a projectile (e.g., bullet). In one embodiment, each hole 103 of the plurality of holes has a longitudinal axis that extends through the center of the hole 103 and beyond the front face 133 and the rear face 131 of the magazine 11 such that the longitudinal axes of the plurality of holes 103 are at a common elevation when the magazine 11 is held in the upright position. Each of the holes 103 or laterally spaced from one another across the magazine 11. When a hole 103 of the plurality of holes has its projectile in a position to be fired from the air gun 105, the longitudinal axis of that hole 103 aligns with a longitudinal axis of a barrel 505 of the air gun 105.

The front rim 132 extends from a front face 133 of the magazine 11. The front rim 132 encircles the hole 103 of the plurality of holes extending through the magazine 11. In one embodiment, the front rim 132 is configured to engage a barrel seal 506 of the air gun 105. The barrel seal 506 is configured and air from escaping the air gun 105 where the magazine 11 interfaces with a barrel 505 of the air gun 105.

The rear rim 130 extends from a rear face 131 of the magazine 11. The rear rim 130 encircles a hole 103 of the plurality of holes extending through the magazine 11. In one embodiment, the rear rim 130 is configured to engage an air orifice seal 508 of the air gun 105. The air orifice seal 508 is configured to prevent air from escaping the air gun where the magazine 11 interfaces with an air output orifice 507 of the air gun 105.

Figure 4:
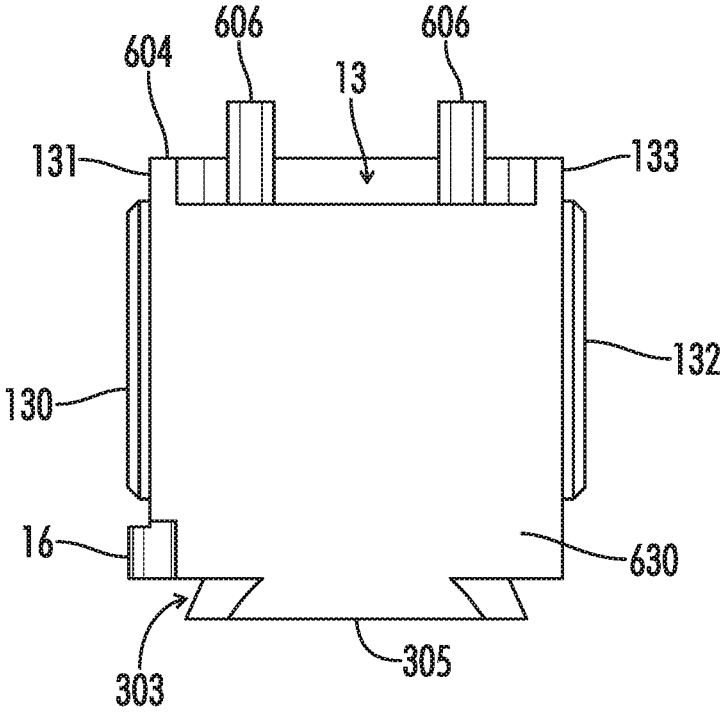
FIG. 4 is a right side perspective view of the magazine of FIG. 1
Figure 5:
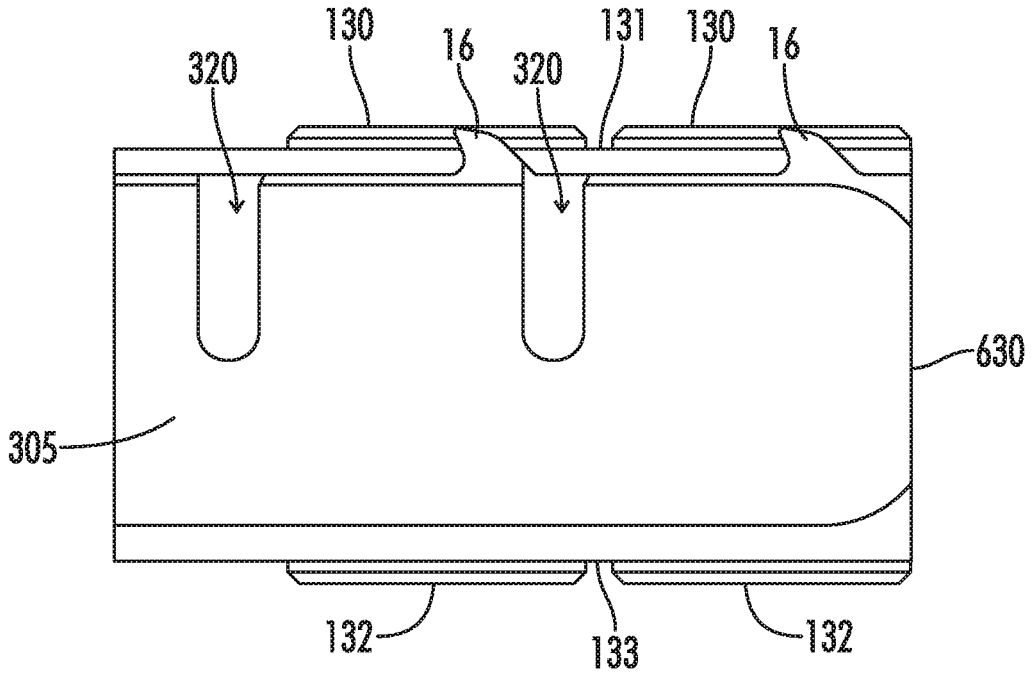
FIG. 5 is a bottom perspective view of the magazine of FIG. 1.
Figure 6:
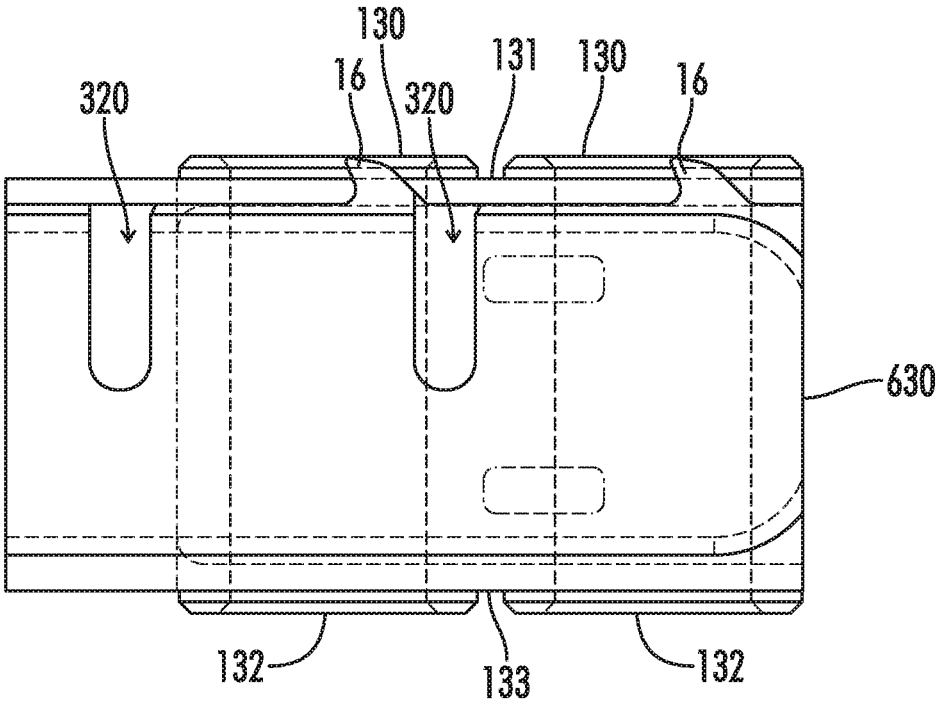
FIG. 6 is a bottom x-ray or see-through view of the magazine of FIG. 1.
Figure 7:
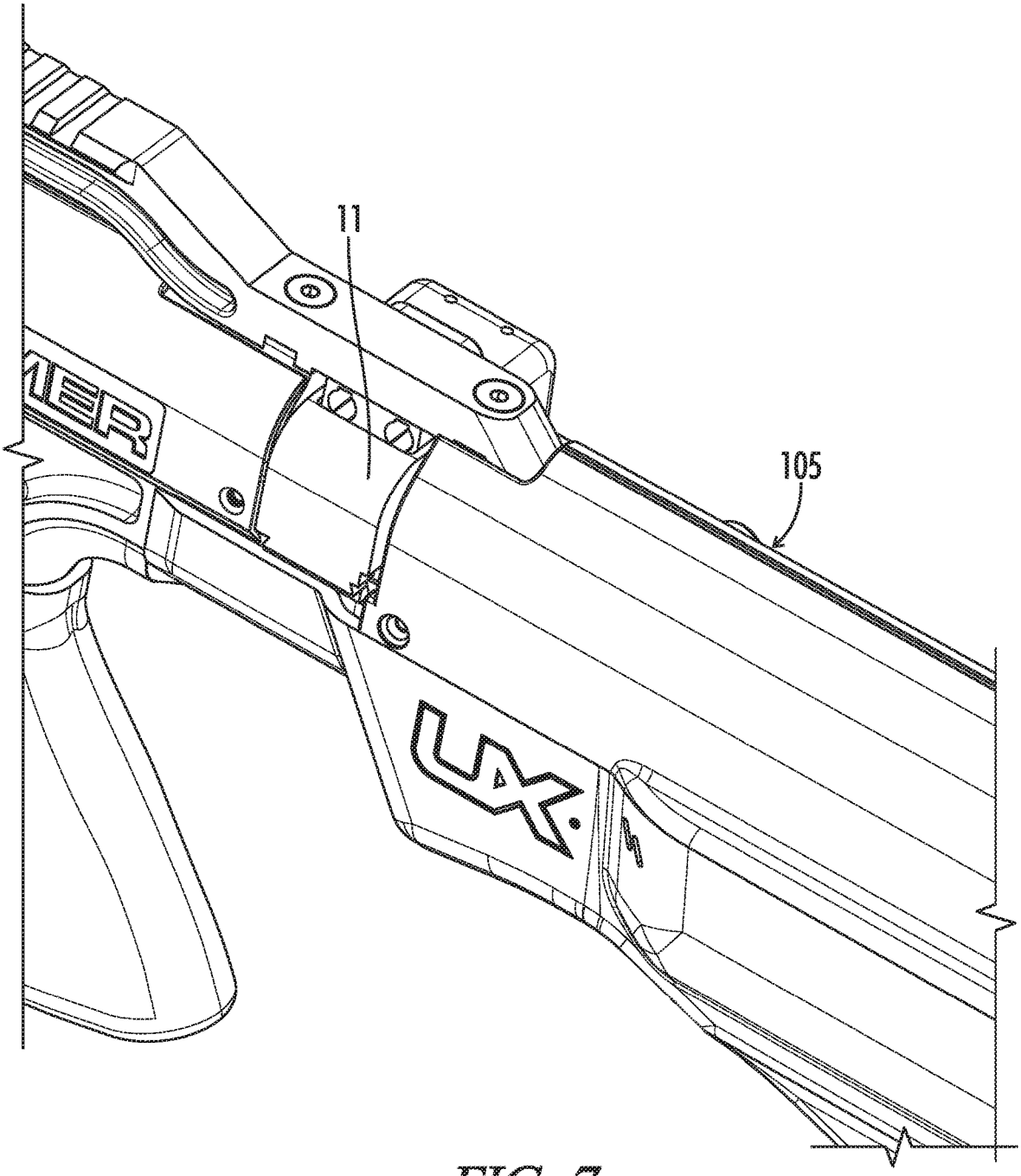
FIG. 7 is an elevated rear perspective view of the magazine of FIG. 1 loaded in an air gun.
Figure 8:
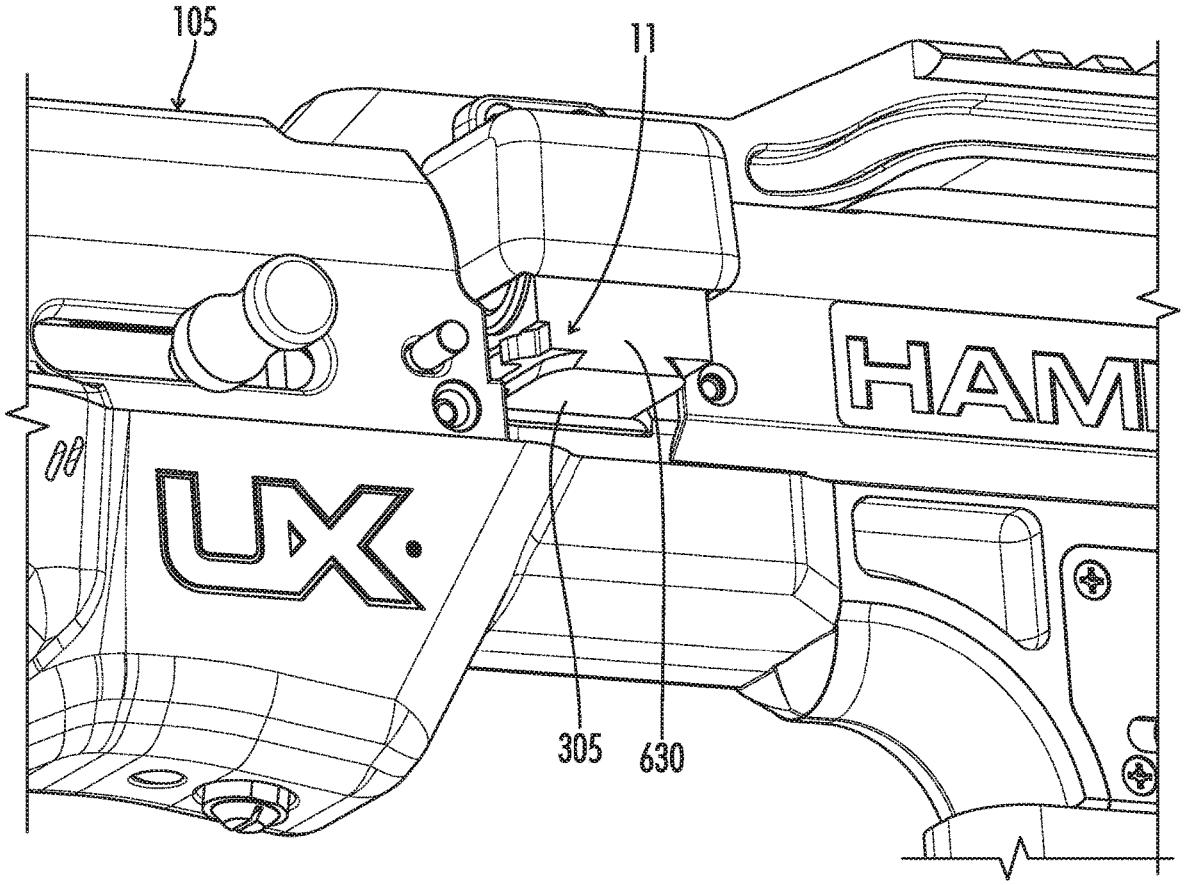
FIG. 8 is a depressed rear right perspective view of the magazine of FIG. 1 loaded in an air gun.
Figure 9:
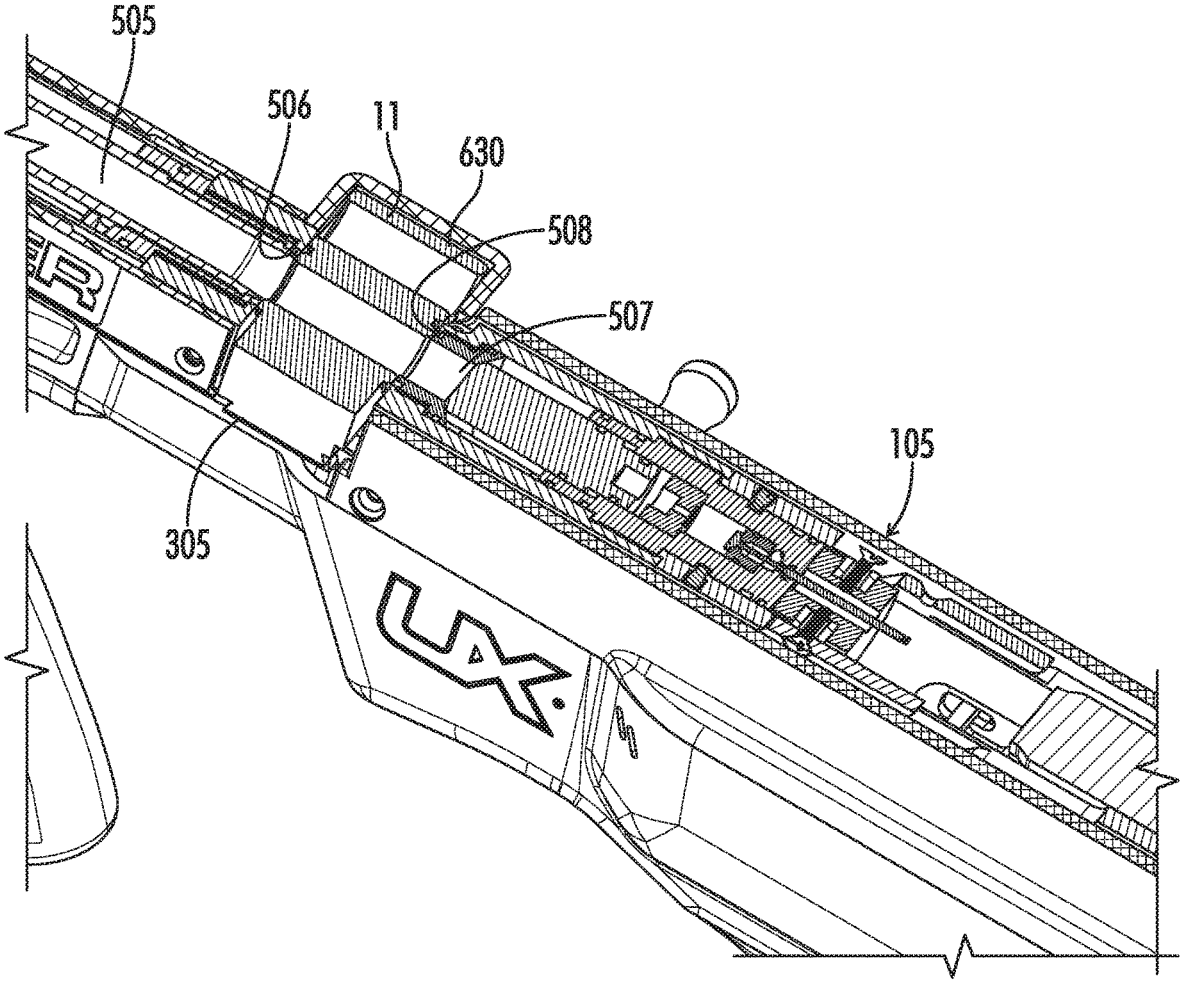
FIG. 9 is a rear left isometric cutaway view of the magazine of FIG. 1 loaded in an air gun, wherein the cutaway is taken along a longitudinal axis of a hole through the magazine.
Figure 10:
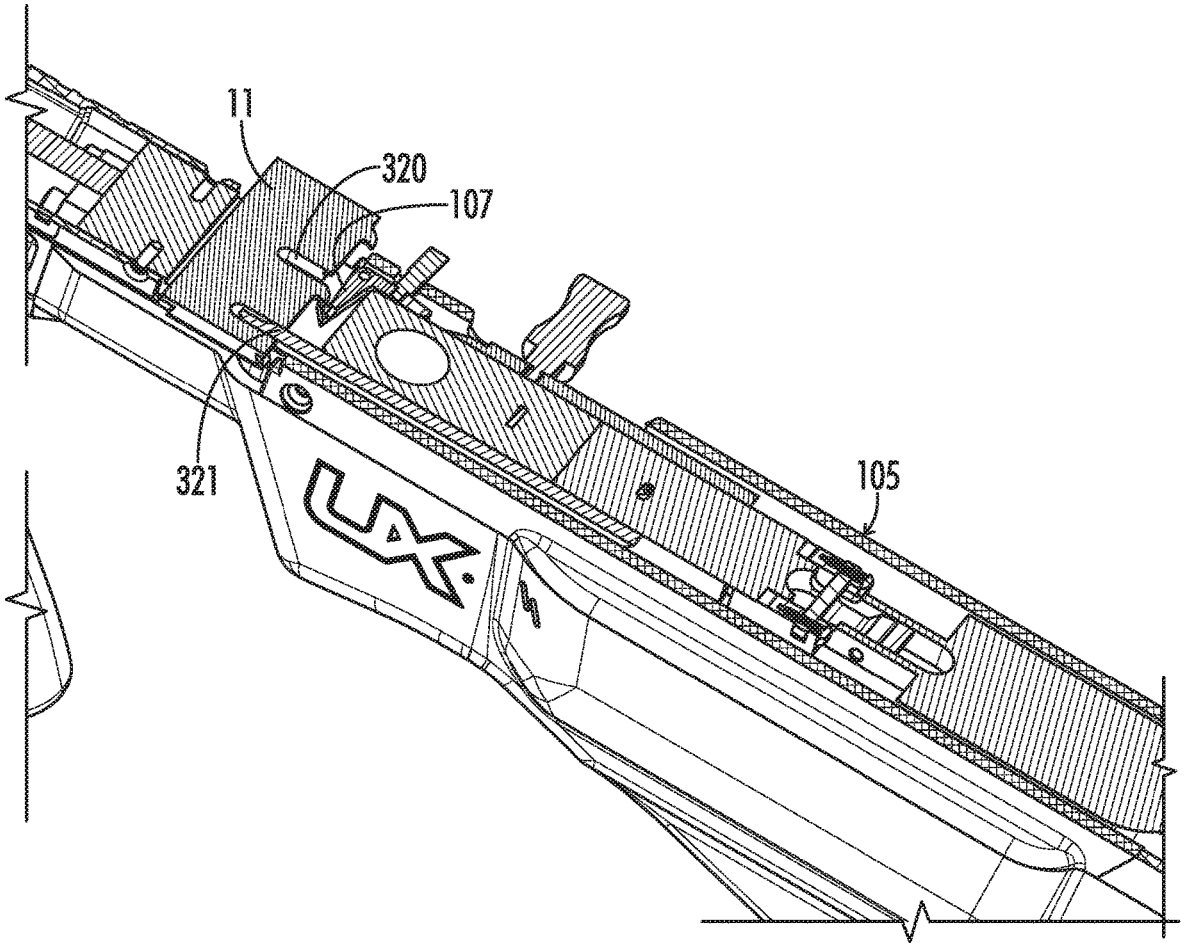
FIG. 10 is a rear left isometric cutaway view of the magazine of FIG. 1 loaded in an air gun, wherein the cutaway is taken at a top of a notch of the magazine.

In one embodiment, magazine 11 further includes a dovetail 303 (see FIG. 4). The dovetail 303 extends laterally along the magazine 11. The dovetail 303 is configured to engage a complementary track of the air gun 105 to align the magazine 11 within the air gun 105. In one embodiment, the dovetail 303 extends along the magazine 11 at a bottom 305 of the magazine 11, and forms the bottom 305 of the magazine 11. The bottom 305 of the magazine 11 is determined when the magazine 11 is in the upright position.

In one embodiment, the magazine 11 further includes a plurality of notches 320. Each notch 320 corresponds to a hole 103 of the plurality of holes. Each notch 320 is configured to receive a locator pin 321 of the air rifle 105. Each notch 320 is in the same position with respect to the hole 103 to which the notch 320 corresponds. Each notch 320 extends forward from the rear face 131 of the magazine 11. Each notch 320 is formed at the bottom 305 of the magazine 11.

In one embodiment, the magazine 11 further includes a plurality of gear teeth 16. Each gear tooth 16 corresponds to a hole 103 of the plurality of holes. Each gear tooth 16 is configured to engage a pawl arm 107 of the air gun 105 to stop the air gun 105 from advancing the magazine 11 to a next hole 103 of the plurality of holes 103. Each gear tooth 16 is in the same location with respect to the hole 103 corresponding to that gear tooth 16. Each gear tooth 16 extends rearward from the magazine 11. In one embodiment, each gear tooth 16 is above the laterally extending dovetail 303 of the magazine 11 and below the holes 103 when the magazine is in the upright position.

In one embodiment, the magazine 11 further includes a guide slot 13. The guide slot 13 extends laterally along the magazine 11. The guide slot 13 is configured to receive a complementary protrusion of the air rifle 105 to align the magazine 11 within the air rifle 105. In one embodiment, the guide slot 13 extends along the magazine 11 at a top 604 of the magazine 11. The top 604 of the magazine 11 is determined when the magazine 11 is in the upright position. In one embodiment, the magazine 11 further includes at least one guide 606 in the guide slot 13. The at least one guide 606 extends upwardly from the guide slot 13 when the magazine 11 is in the upright position. The at least one guide 606 is configured to engage a corresponding groove in the protrusion of the air rifle 105 to align the magazine 11 within the air rifle 105. The guide 606 may extend above the top face 604 of the magazine 11.

It will be understood that the magazine is preloaded with projectiles in the holes 103 or chambers (i.e., a user places projectiles in the holes 103), and the magazine body 11 is then inserted into the air gun 105. When a selected hole 103 or chamber is aligned with the bore of the air gun 105 (i.e., the longitudinal axis of the barrel 505), the projectile can be fired from the gun by a discharge of gas (e.g., air or helium) from the air output orifice 507 of the air gun 105 forcing the projectile through the barrel 505 of the air gun 105.

In one embodiment, the magazine 11 is inserted into the air gun 105 by aligning the dovetail 303 with the complementary track of the air gun 105 and then aligning the guide slot 13 with the protrusion of the air gun 105. In one embodiment, a right end of the dovetail 303 is tapered or rounded to promote initial alignment of the dovetail 303 with the track. The user continues sliding the magazine 11 into the air rifle until the guides 606 engage the complementary groove in the protrusion of the air gun 105 and the magazine 11 is slid fully to the right (in a right-hand gun which may be reversed for a left-hand gun). A spring (not shown) of the air gun 105 at the right end 630 of magazine 11 (in a right-hand magazine and air gun) applies constant pressure to the right end or right face 630 of the magazine 11. After a shot, mechanically cocking the gun 105 using known mechanisms known to those skilled in the art moves the pawl arm 107 and allows the magazine 11 to advance to a next chamber or hole 103 (i.e., align the next hole 103 with a barrel 505 and output air orifice 507 of the rife) under the influence of the spring. That is, the pawl arm 107 is momentarily tripped, the spring slides the magazine 11 to the left, and the pawl arm 107 catches the next gear tooth 16 in the series. The locator pin 321 is then pressed into the corresponding notch 320 to precisely align the hole 103 with the barrel 505 and output air orifice 507 (and the associated barrel seal 506 and air orifice seal 508) to make the air gun 105 ready for the next shot.

Although sealing is important to higher muzzle energy output, there are no seals at the entrance and exit of each hole or chamber 103. The seals 506, 508 are mechanically trapped at the air output orifice 507 and at the entrance of the barrel 505. These seals have been tested for wear and pressure over 700×. The seals are mechanically trapped and created of a seal material which has enough lubricity to allow easy lateral movement across of the magazine body 11 and enough compression to seal against the front rim 132 and rear rim 130. The construction of the magazine 11 produces a chamber handling up to 6000 psi and operating nominally at 3000 psi in the air gun even though the magazine 11 does not have any seals attached thereto.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful LINEAR CHAMBER MAGAZINE it is not intended that such references be construed as limitations upon the scope of this invention except as set forth in the following claims.

What is claimed is:

1. A magazine for an air gun, said magazine comprising:

a plurality of laterally spaced holes extending through the magazine, wherein each hole of the plurality of holes is configured to receive a projectile and has a longitudinal axis that extends through a center of the hole and beyond a front face and a rear face of the magazine such that the longitudinal axes of the plurality of holes are at a common elevation when the magazine is held in an upright position; and a guide slot defined in the magazine, the guide slot configured to receive a portion of the air gun to align the magazine within the air gun and prevent the magazine from exiting a side of the air gun when the magazine is received in the air gun.

2. The magazine of claim 1, wherein:

the guide slot is configured to align the longitudinal axis of at least one hole of the plurality of holes with a longitudinal axis of a barrel of the air gun.

3. The magazine of claim 1, wherein:

the guide slot extends laterally along the magazine; and the guide slot is configured to receive a protrusion of the air gun to align the magazine within the air gun.

4. The magazine of claim 3, wherein:

the guide slot extends laterally along a top of the magazine; and the top of the magazine is determined when the magazine is in an upright position.

5. The magazine of claim 1, further comprising:

at least one guide in the guide slot, the at least one guide extending from the guide slot and configured to engage a portion of the air gun to align the magazine within the air gun.

6. The magazine of claim 5, wherein:

the at least one guide extends upwardly from the guide slot when the magazine is in the upright position; and the at least one guide is configured to engage a corresponding groove of the air gun to align the magazine within the air gun.

7. The magazine of claim 1, wherein:

the front face of the magazine is configured to engage a first seal of the air gun and prevent air from escaping the air gun where the magazine interfaces with a barrel of the air gun; or the rear face of the magazine is configured to engage a second seal of the air gun and prevent air from escaping the air gun where the magazine interfaces with an air output orifice of the air gun.

8. A magazine for an air gun, said magazine comprising:

a magazine body having a front face and a rear face;

a plurality of laterally spaced holes extending through the magazine body from the front face to the rear face, each hole of said plurality of holes configured to receive a projectile;

a guide slot defined in the magazine body, the guide slot configured to receive a portion of the air gun to align the magazine within the air gun and prevent the magazine from exiting a side of the air gun when the magazine is received in the air gun; and a plurality of notches, each notch corresponding to a hole of the plurality of holes; wherein:

each notch is configured to receive a locator pin of the air gun, each notch is in the same position with respect to the hole corresponding to that notch; and each hole is aligned with a bore of the air gun when the locator pin is received in the notch corresponding to that hole.

9. The magazine of claim 8, wherein:

each notch extends forward from the rear face of the magazine.

10. The magazine of claim 8, wherein:

each notch is formed at a bottom of the magazine, and the bottom of the magazine is determined when the magazine is in an upright position.

11. The magazine of claim 8, further comprising:

a dovetail extending laterally along a bottom of the magazine, said dovetail configured to engage a track of the air gun to align the magazine within the air gun, wherein the bottom of the magazine is determined when the magazine is in an upright position.

12. A magazine for an air gun, said magazine comprising:

a plurality of holes extending through the magazine, each hole of said plurality of holes configured to receive a projectile, wherein the plurality of holes are spaced laterally from one another across the magazine; and a guide slot defined in the magazine, the guide slot configured to receive a portion of the air gun to align the magazine within the air gun and prevent the magazine from exiting a side of the air gun when the magazine is received in the air gun;

wherein a face of the magazine is configured to engage a seal of the air gun to prevent air from escaping the air gun where the face of the magazine interfaces with the seal.

13. The magazine of claim 12, wherein:

the face of the magazine is a front face of the magazine;

the seal of the air gun is a barrel seal; and the front face of the magazine is configured to engage the barrel seal to prevent air from escaping the air gun where the magazine interfaces with a barrel of the air gun.

14. The magazine of claim 12, wherein:

the face of the magazine is a rear face of the magazine;

the seal of the air gun is an air orifice seal; and the rear face of the magazine is configured to engage the air orifice seal to prevent air from escaping the air gun where the magazine interfaces with an air output orifice of the air gun.

15. The magazine of claim 12, further comprising:

a rim protruding from the face of the magazine around a hole of the plurality of holes.

16. The magazine of claim 15, wherein:

the rim is an annular rim encircling the hole of the plurality of holes.

17. The magazine of claim 12, further comprising:

a dovetail extending laterally along the magazine, said dovetail configured to engage a track of the air gun to align the magazine within the air gun; wherein:

the dovetail extends along the magazine at a bottom of the magazine; and the bottom of the magazine is determined when the magazine is in an upright position.

18. The magazine of claim 12, further comprising:

a plurality of gear teeth, each gear tooth corresponding to a hole of the plurality of holes;

wherein each gear tooth is configured to engage a pawl of the air gun to stop the air gun from advancing the magazine to a next hole of the plurality of holes; and wherein each gear tooth is in the same position with respect to the hole corresponding to that gear tooth.

19. The magazine of claim 12, wherein:

the guide slot is configured to align at least one hole of the plurality of holes with a bore of the air gun.

* * * * *